US007015881B2

(12) United States Patent
Isobe

(10) Patent No.: US 7,015,881 B2
(45) Date of Patent: Mar. 21, 2006

(54) PLASMA DISPLAY PAIRED ADDRESSING

(75) Inventor: Norifusa Isobe, New Paltz, NY (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 107 days.

(21) Appl. No.: 10/744,371

(22) Filed: Dec. 23, 2003

(65) Prior Publication Data

US 2005/0134190 A1 Jun. 23, 2005

(51) Int. Cl.

| | |
|---|---|
| ***G09G 3/10*** | (2006.01) |
| ***G09G 3/20*** | (2006.01) |
| ***G09G 3/28*** | (2006.01) |
| ***G09G 3/30*** | (2006.01) |

(52) U.S. Cl. ..... 345/60; 345/55; 345/76; 315/169.4

(58) Field of Classification Search .. 315/169.1–169.4; 345/55, 60, 63, 76, 77

See application file for complete search history.

(56) References Cited

U.S. PATENT DOCUMENTS

| | | | | |
|---|---|---|---|---|
| 4,772,884 | A * | 9/1988 | Weber et al. | 345/67 |
| 5,745,086 | A * | 4/1998 | Weber | 345/63 |
| 5,805,122 | A * | 9/1998 | Bongaerts et al. | 345/60 |
| 6,088,009 | A * | 7/2000 | Moon | 345/60 |
| 6,118,214 | A * | 9/2000 | Marcotte | 313/582 |
| 6,184,848 | B1 * | 2/2001 | Weber | 345/60 |
| 6,384,802 | B1 * | 5/2002 | Moon | 345/60 |
| 6,693,389 | B1 * | 2/2004 | Marcotte et al. | 315/169.4 |
| 6,784,857 | B1 * | 8/2004 | Nakamura | 345/60 |
| 6,791,514 | B1 * | 9/2004 | Setoguchi et al. | 345/60 |
| 6,844,685 | B1 * | 1/2005 | Lee | 315/169.3 |
| 6,900,598 | B1 * | 5/2005 | Hibino et al. | 315/169.4 |
| 2002/0033781 | A1 * | 3/2002 | Kang et al. | 345/67 |
| 2004/0012546 | A1 * | 1/2004 | Takagi et al. | 345/60 |
| 2004/0130508 | A1 * | 7/2004 | Mizobata | 345/60 |
| 2005/0128166 | A1 * | 6/2005 | Tanaka et al. | 345/60 |
| 2005/0140585 | A1 * | 6/2005 | Seo et al. | 345/60 |
| 2005/0156827 | A1 * | 7/2005 | Seo et al. | 345/60 |

* cited by examiner

*Primary Examiner*—Wilson Lee
*Assistant Examiner*—Leith A. Al-Nazer
(74) *Attorney, Agent, or Firm*—Ohlandt, Greeley, Ruggiero & Perle, L.L.P.

(57) ABSTRACT

There is provided a method for controlling electrodes in a plasma display. The method includes providing addressing signals to (a) a first electrode in a first row, a second electrode in a second row, a fifth electrode in a fifth row and a sixth electrode in a sixth row; and subsequently to (b) a third electrode in a third row and a fourth electrode in a fourth row. The second row is adjacent to the first row, the third row is adjacent to the second row, the fourth row is adjacent to the third row, the fifth row is adjacent to the fourth row and the sixth row is adjacent to the fifth row.

23 Claims, 3 Drawing Sheets

PLASMA DISPLAY PAIRED ADDRESSING

BACKGROUND OF THE INVENTION

1. Field of the Invention

The present invention relates to plasma displays, and more particularly, to a plasma display in which vertical crosstalk between pixels is suppressed without adversely affecting wall charges of electrodes.

2. Description of the Related Art

A plasma display includes a front plate and a rear plate sealed together and having a space therebetween filled with a dischargeable gas. The front plate includes horizontal rows of electrodes, each row being configured with a sustain electrode in parallel with a scan electrode. The scan electrodes and the sustain electrodes are covered by a dielectric layer and a magnesium oxide (MgO) layer. The back plate supports vertical barrier ribs and vertical column electrodes. In a color display, individual column electrodes are covered with red, green, or blue (RGB) phosphors. A pixel is defined as an area proximate to an intersection of (i) a scan electrode and a sustain electrode, and (ii) three column electrodes for colors red, green, and blue, respectively. A subpixel corresponds to an intersection of a red, green or blue column electrode with an electrode pair of a sustain electrode and a scan electrode.

The scan electrodes are driven individually in an addressing period in which each row may be selected such that sub-pixels along that row may be addressed via an addressing discharge triggered by the application of a data voltage on a vertical column electrode. During a sustain period, a common sustain pulse is applied to all scan electrodes to repetitively generate plasma discharges at each sub-pixel site addressed during the addressing period.

The sustain electrodes provide a reference point for the scan electrodes during the addressing operation. During the sustain period, a common sustain pulse is applied to all sustain electrodes out of phase with the sustain pulses applied to the scan electrodes, such that plasma discharges alternate direction between sustain and scan electrodes.

There are plasma displays in which pairs of sustain electrodes are interdigitated with pairs of scan electrodes. In one example, the electrodes are arranged in a sequence of:

row 1, sustain electrode;
row 1, scan electrode;
row 2, scan electrode;
row 2, sustain electrode;
row 3, sustain electrode;
row 3, scan electrode;
row 4, scan electrode;
row 4, sustain electrode;
etc.

Thus, the scan electrodes of rows 1 and 2 form a first pair of scan electrodes, and the scan electrodes of rows 3 and 4 form a second pair of scan electrodes. The sustain electrodes of rows 2 and 3 form a pair of sustain electrodes that is interdigitated with the first and second pairs of scan electrodes.

The interdigitation of the pairs of electrodes results in a lower inter-electrode capacitance as compared to non-interdigitated electrodes. The lower inter-electrode capacitance is of benefit in a large area plasma display.

An interpixel gap is a region of space between adjacent pixels. In a case where an interpixel gap spacing is made small, a common potential present on a pair of electrodes can result in an erroneous crosstalk discharge and/or wall charge leakage in a neighboring pixel site, particularly in a vertical dimension. Note that for interdigitated pairs of electrodes, as described above, some interpixel gaps fall between adjacent scan electrodes, and some interpixel gaps fall between adjacent sustain electrodes.

A sustain gap is a region of space between a scan electrode and a sustain electrode within which the discharge occurs. A positively charged electrode serves as an anode and a negatively charged electrode serves as a cathode. When a sufficient voltage is applied across the sustain gap, the gas will break down and form a discharge plasma. The discharge plasma has two distinct regions, namely a positive column and a negative glow. The positive column is predominantly composed of fast moving electrons seeking a positive charge on the surface of the anode electrode. Conversely, the negative glow contains slow moving ions drifting toward and across the negatively charged cathode electrode. The duration of the discharge is limited by the amount of charge on the dielectric surfaces of the electrodes.

Each scan electrode is driven by an independently addressable scan driver. During an addressing period for a pixel, the scan driver for the pixel's scan electrode outputs a row select pulse that is coincident with a data pulse being applied to a column electrode of the pixel. Consequently, an address discharge occurs between the pixel's scan electrode and sustain electrode. The address discharge produces a positive column region that can spread across an interpixel gap that separates sustain electrodes, and produces a negative glow region that can reduce the wall charge on the adjacent scan electrode across an interpixel gap that separates a scan electrode pair.

U.S. patent application Ser. No. 10/305,560 describes a technique of vertical crosstalk suppression coupled with interlaced addressing that minimizes positive column crosstalk. However, when the interlaced addressing addresses at a first scan electrode in a scan electrode pair, some wall charge leakage occurs at the discharge site of the second scan electrode in the scan electrode pair, thus reducing the wall charge of the second scan electrode. More specifically, the slow moving negative glow portion of the address discharge spreads across the first scan electrode and has a tendency to deplete the wall charge on the second scan electrode. Subsequently, when the second scan electrode is addressed, the reduced wall charge requires a higher addressing voltage that would have been required had the wall charge not been reduced. The higher addressing voltage is undesirable because power dissipation is proportional to the square of the voltage, and positive column crosstalk is more likely to occur at higher addressing voltages.

SUMMARY OF THE INVENTION

A method for controlling electrodes in a plasma display includes providing addressing signals to (a) a first electrode in a first row, a second electrode in a second row, a fifth electrode in a fifth row and a sixth electrode in a sixth row; and subsequently to (b) a third electrode in a third row and a fourth electrode in a fourth row. The second row is adjacent to the first row, the third row is adjacent to the second row, the fourth row is adjacent to the third row, the fifth row is adjacent to the fourth row and the sixth row is adjacent to the fifth row.

A plasma display includes a first electrode in a first row, a second electrode in a second row adjacent to the first row, a third electrode in a third row adjacent to the second row, and a fourth electrode in a fourth row adjacent to the third row. The first and second electrodes are enabled and disabled concurrently with one another, and the third and fourth electrodes are enabled and disabled concurrently with one another.

In the plasma display, vertical crosstalk between pixels is suppressed without adversely affecting wall charges of electrodes and without adversely requiring a higher addressing voltage for an adjacent pixel. Also, addressing margin is improved by reducing the minimum addressing voltage required to address the second scan electrode in a pair.

DESCRIPTION OF THE INVENTION

Figure 1:
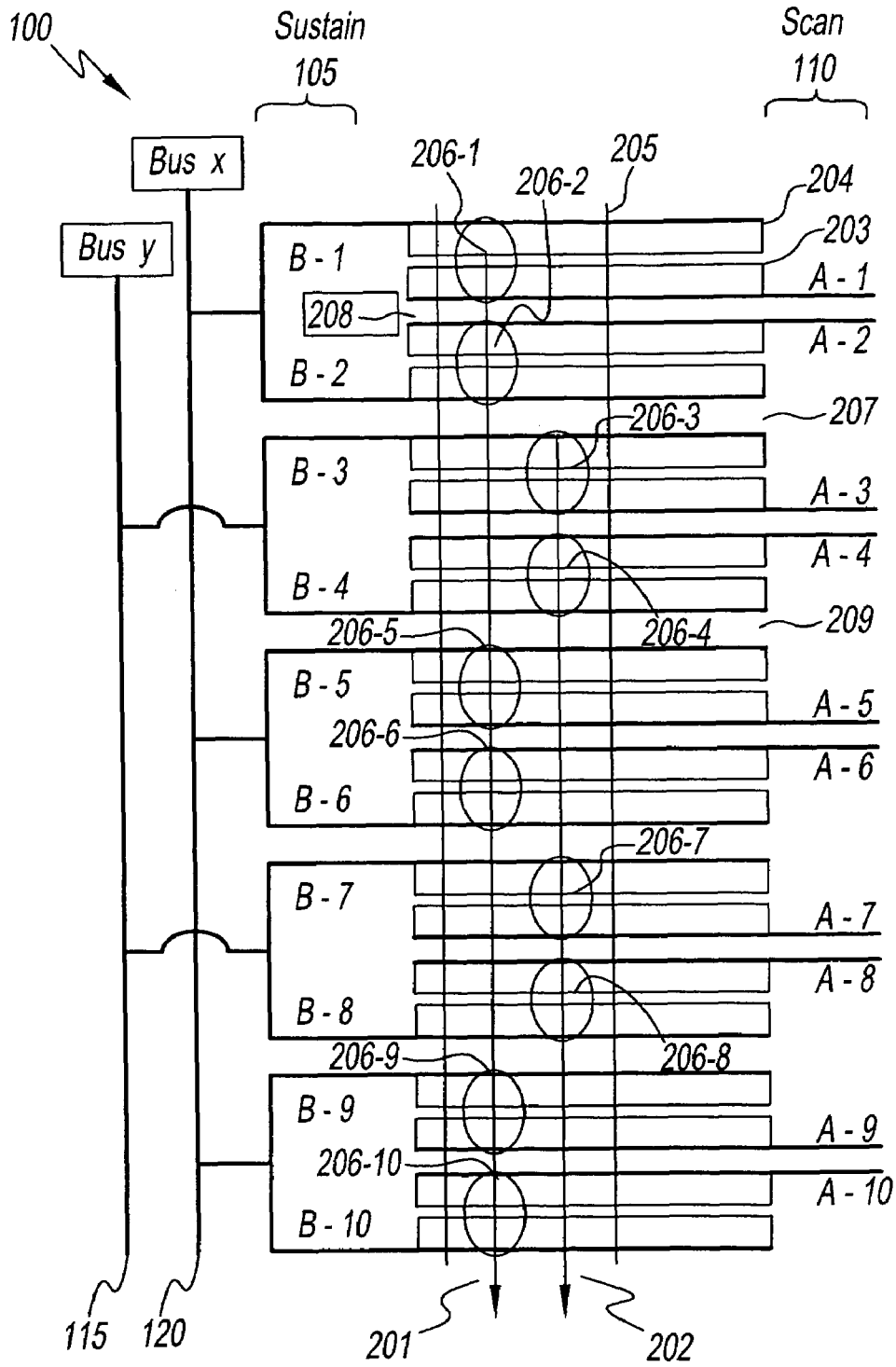
FIG. 1 is an illustration of a configuration of electrodes in a plasma display.

FIG. 1 is an illustration of a configuration of electrodes in a plasma display, a portion of which is illustrated and designated with as plasma display 100. Plasma display 100 includes a plurality of sustain electrodes 105 and a plurality of scan electrodes. Ten individuals of sustain electrodes are shown and designated as sustain electrodes B-1, B-2, . . . , B-10. Similarly, ten individuals of scan electrodes 110 are shown and designated as scan electrodes A-1, A-2, . . . , A-10.

Sustain electrodes 105 and the scan electrodes 110 are organized into rows, where row 1 includes sustain electrode B-1 and scan electrode A-1, row 2 is adjacent to row 1 and includes sustain electrode B-2 and scan electrode A-2, . . . , and row 10 is adjacent to row 9 and includes sustain electrode B-10 and scan electrode A-10.

Pairs of sustain electrodes 105 are interdigitated with pairs of scan electrodes 110. For example, scan electrodes A-1 and A-2 form a pair of scan electrodes, and scan electrodes A-3 and A-4 also form a pair of scan electrodes. Sustain electrodes B-2 and B-3 form a pair of sustain electrodes that is interdigitated with (i) the pair of scan electrodes A-1 and A-2, and (ii) the pair of scan electrodes A-3 and A-4. Note further that scan electrodes A-1 and A-2 are between sustain electrodes B-1 and B-2, and scan electrodes A-3 and A-4 are between sustain electrodes B-3 and B-4.

Each of the sustain and scan electrodes includes a metal portion and an electrically conductive transparent region. For example, a metal portion 204 is shown for sustain electrode B-1, and a transparent region 203 is shown for scan electrode A-1. Transparent region 203 is made of a material such as indium tin oxide (ITO), through which light can pass. Such materials are only semi-conductive and so the metal portion 204 provides a highly conductive path to support the low conductivity of the transparent material. As the metal portion 204 is opaque, a trade off exists between transparency and conductivity.

A discharge site 206-1 is shown for row 1, between sustain electrode B-1 and scan electrode A-1. Similarly, there are discharge sites 206-2, 206-3, . . . , and 206-10 for rows 2–10, respectivley.

Vertical barrier ribs prevent a discharge at a discharge site from affecting a horizontally neighboring discharge site. For example, a barrier rib 205 prevents discharge sites 206-1 through 206-10, which are shown as being on the left side of barrier rib 205, from affecting neighboring sites to the right side of barrier rib 205.

A pixel is defined as an area proximate to an intersection of (i) a scan electrode and a sustain electrode, and (ii) three column electrodes (not shown) for colors red, green, and blue, respectively. A subpixel corresponds to an intersection of a red, green or blue column electrode with an electrode pair of a sustain electrode and a scan electrode. The operations in the present disclosure are applicable to both a pixels and a subpixels, but for simplicity, describes the operations in the context of a pixel.

An interpixel gap 208 is shown between scan electrodes A-1 and A-2, i.e., between rows 1 and 2. An interpixel gap 207 is shown between sustain electrode B-2 and sustain electrode B-3, i.e., between rows 2 and 3. An interpixel gap 209 is shown between sustain electrode B-4 and sustain electrode B-5, i.e., between rows 4 and 5. Although not designated with reference numbers an interpixel gap also exists between rows 3 and 4, and between each of adjacent rows 5–10.

Sustain electrodes B-1, B-2, B-5, B-6, B-9 and B-10 are coupled to a bus x 120, and sustain electrodes B-3, B-4, B-7 and B-8 are coupled to a bus y 115. Signals from bus x 120 control sustain electrodes B-1, B-2, B-5, B-6, B-9 and B-10, and signals from bus y 115 control sustain electrodes B-3, B-4, B-7 and B-8. Sustain electrodes B-1, B-2, B-5, B-6, B-9 and B-10 are enabled and disabled concurrently with one another. Similarly, sustain electrodes B-3, B-4, B-7 and B-8 are enabled and disabled concurrently with one another.

Bus x 120 may be configured as either a single conductor in common with each of sustain electrodes B-1, B-2, B-5, B-6, B-9 and B-10, or it may be configured as a plurality of discrete lines for individually controlling sustain electrodes B-1, B-2, B-5, B-6, B-9 and B-10. Similarly, busy 115 may be configured as either a single conductor in common with each of sustain electrodes B-3, B-4, B-7 and B-8, or it may be configured as a plurality of discrete lines for individually controlling sustain electrodes B-3, B-4, B-7 and B-8.

An image is displayed by plasma display 100 by configuring states, i.e., ON or OFF, of pixels of plasma display 100. Time is partitioned into frames, and each frame is partitioned into subfields.

Figure 2:
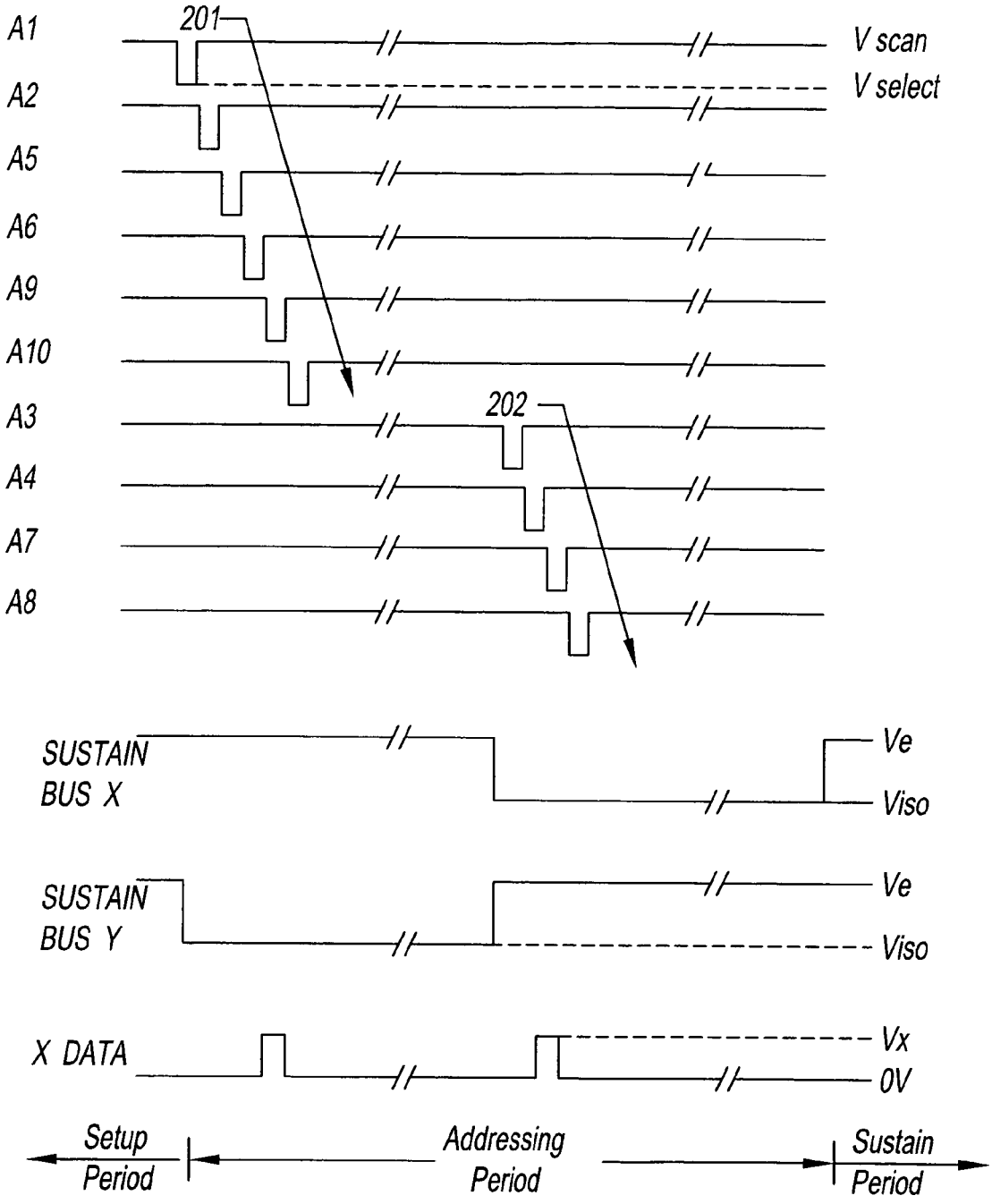
FIG. 2 is a graph of various signals that are applied to the electrodes of FIG. 1.

FIG. 2 is a graph of various signals that are applied to the electrodes of FIG. 1. The signals include scan electrode drive signals A1 through A10, a sustain bus x signal, a sustain bus y signal, and an X data signal. FIG. 2 represents a subfield, which is, in turn, partitioned into a setup period, an addresssing period and a sustain period.

During the setup period, any ON pixels are turned OFF, and a weak discharge is generated at each display sub-pixel to prime the magnesium oxide layer in preparation for addressing.

During the addressing period, scan drive signals A1–A10 are applied to scan electrodes A-1 through A-10, respectively, where a low-going scan drive signal A1–A10 (from voltage Vscan to voltage Vselect) enables its corresponding row for addressing. In FIGS. 1 and 2, a sequence for addressing scan electrodes A-1 through A-10 is represented by addressing sequence 201 and addressing sequence 202.

After a given row is enabled, column drivers (not shown) are loaded with image data. In FIG. 2, the X Data waveform represents an output of a column driver a column driver lines. The column drivers apply column voltage Vx to selected column electrodes. The coincidence, at a pixel site, of a selected row, i.e., a low pulse provided by A1–A10, and an applied column voltage Vx, initiates a weak discharge that cascades into a discharge between the selected scan electrode 110 and its neighboring sustain electrode 105.

At the beginning of the addressing period, the sustain bus y signal reduces the voltage supplied to sustain electrodes B-3, B-4, B-7 and B-8 (from Ve to Viso). This disables sustain electrodes B-3, B-4, B-7 and B-8 for the first half of the addressing period. Note that during the first half of the addressing period, the sustain bus x signal is at voltage level Ve, which enables sustain electrodes B-1, B-2, B-5, B-6, B-9 and B-10.

Half way through the addressing period, the sustain bus y signal restates the voltage on sustain electrodes B-3, B-4, B-7 and B-8 to Ve, thus enabling sustain electrodes B-3, B-4, B-7 and B-8. Also, the sustain bus x signal reduces the voltage on sustain electrodes B-1, B-2, B-5, B-6, B-9 and B-10 to Viso, thus disabling sustain electrodes B-1, B-2, B-5, B-6, B-9 and B-10.

In FIG. 2, during the second half of the addressing period, an X data pulse is shown coinciding with a low-going pulse on scan drive signal A4. Assume that this coincidence of signals causes an address discharge at discharge site 206-4. Crosstalk between sustain electrode B-4 and sustain electrode B-5 is minimized by the lower potential (i.e., Viso) on sustain electrode B-5 during the second half of the addressing period. This is because the enabling voltage Ve on sustain electrode B-4 is referenced to the voltage on scan electrode A-4, and the disabling voltage Viso on sustain electrode B-5, when referenced to the voltage on scan electrode A-4 is a lower magnitude than the enabling voltage Ve.

During addressing sequence 201, scan electrodes A-1 and A-2 are addressed sequentially, followed by scan electrodes A-5 and A-6, and then scan electrodes A-9 and A-10. Sustain electrodes B-1, B-2, B-5, B-6, B-9 and B-10 are enabled by being driven high by the sustain bus x signal, to initiate address discharges, sequentially, at discharge sites 206-1, 206-2, 206-5, 206-6, 206-9 and 206-10. Note that sustain electrodes B-3 and B-4 are disabled by being driven low, by the sustain bus y signal, to prevent a positive column from spreading across interpixel gaps, e.g., interpixel gap 207, between sustain electrodes 105. Addressing sequence 202 occurs subsequently to addressing sequence 201.

During addressing sequence 202, scan electrodes A-3, A-4, A-7, and A-8 are addressed sequentially. Sustain electrodes B-3, B-4, B-7, and B-8 are enabled by being driven high by the sustain bus y signal, to initiate address discharges, sequentially, at discharge sites 206-3, 206-4, 206-7 and 206-8. Note that sustain electrodes B-1, B-2, B-5, B-6, B-9 and B-10 are disabled by being driven low by the sustain bus x signal.

While each address discharge at scan electrodes A-1, A-3, and A-5, for example, will deplete some charge from scan electrodes A-2, A-4, and A-6, respectively, the same address discharge energizes the gas that produces priming for the discharges at scan electrodes A-2, A-4, and A-6. This priming is a stronger benefit to addressing than the wall charge depletion is a deterrent, and thus, improves the overall addressing margin. Addressing margin is an operating window between the minimum voltages required to address all the sub-pixels in the display and the maximum voltages which may be applied before vertical crosstalk occurs.

The address discharge at discharge site 206-3 will form between scan electrode A-3 and an intersecting vertical column electrode driven with the data voltage. As the address discharge progresses, a fast moving positive column extends towards sustain electrode B-3 driven with the enabling voltage Ve. The positive column will not extend across interpixel gap 207 due to the lower isolation voltage Viso applied to sustain electrode B-2. Concurrent with the positive column growth, the negative glow region of the address discharge will spread slowly across the scan electrode A-3. Although retarded from spreading across interpixel gap 209 to scan electrode A-4 by the application of voltage Vscan on scan electrode A-4, the negative glow will reduce the wall charge on the vertical column electrode and scan electrode A-4 in the area surrounding interpixel gap 209.

As the address discharge at scan electrode A-3 completes, the MgO surface and the gas volume are highly energized, and so if discharge site 206-4 is addressed immediately following the addressing of discharge site 206-3, the addressing of discharge site 206-3 serves as a priming to facilitate the formation of an address discharge at discharge site 206-4. As the discharge progresses, a fast moving positive column extends towards sustain electrode B-4, which is driven with the enabling voltage Ve. Because of the lower isolation voltage Viso applied to sustain electrode B-5, the positive column will not extend across interpixel gap 209 to sustain electrode B-5.

Note that the electrode configuration, particularity with the arrangement of bus y 115 and bus x 120, allows sustain electrodes B-3 and B-4 to be driven with the enabling voltage Ve, through bus y 115, for the addressing of scan electrodes A-3 and A-4, while bus x 120 is driven with the isolation voltage Viso, to limit the growth of the positive column. In partnership, the paired addressing sequence allows bus x 120 and bus y 115 to be switched once, mid-way through the addressing period, to minimize the power dissipation consumed by switching sustain electrodes 105 from the enabling voltage Ve to the isolation voltage Viso.

Figure 3:
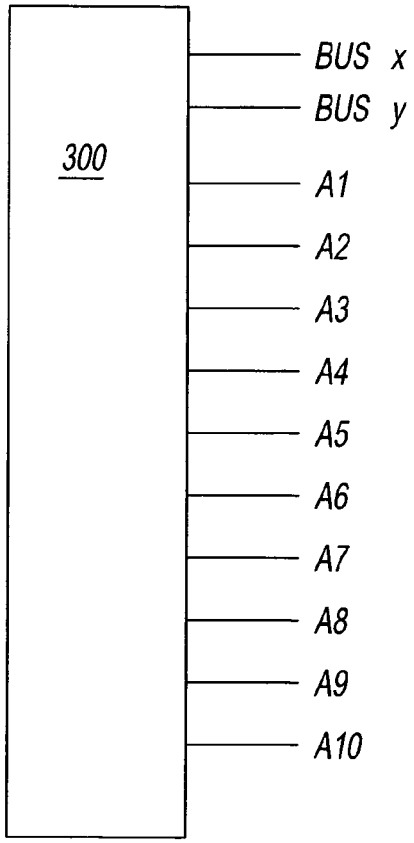
FIG. 3 is a block diagram of a controller for providing signals to the electrodes of FIG. 1.

FIG. 3 is a block diagram of a controller 300 for providing the sustain bus x signal to bus x, the sustain bus y signal to bus y, and the scan drive signals A1–A10 to scan electrodes A-1 through A-10, respectively. Note that the sustain bus x signal is a single signal, and the sustain bus y signal is a single signal. Thus, controller 300 is suitable for a configuration of plasma display 100 in which bus x 120 is a single conductor in common with each of sustain electrodes B-1, B-2, B-5, B-6, B-9 and B-10, and bus y 115 is a single conductor in common with each of sustain electrodes B-3, B-4, B-7 and B-8.

Figure 4:
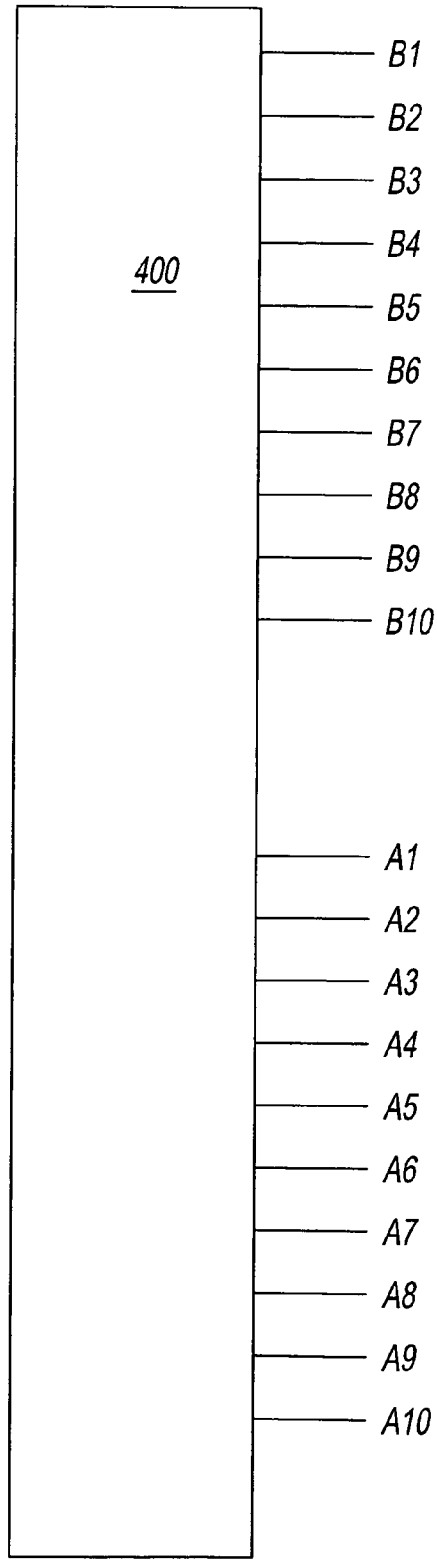
FIG. 4 is a block diagram of an alternative to the controller of FIG. 3.

FIG. 4 is a block diagram of a controller 400 that may serve as an alternative to controller 300. In controller 400, discrete signals B1, B2, b5, B6, B9 and B10, for driving sustain electrodes B-1, B-2, B-5, B-6, B-9 and B-10, respectively, and discrete signals B3, B4, B7 and B8 are for driving sustain electrodes B-3, B-4, B-7 and B-8, respectively, Thus, controller 400 is suitable for a configuration of plasma display 100 in which bus x 120 and bus y 115 are configured as a plurality of discrete lines.

Once completed, the address discharge places the addressed pixel in the ON state. Any column not driven will remain in the OFF state. While the address discharge does produce visible light, it is not of sufficient brightness to represent the image properly. Accordingly, a sustain period follows the addressing period after the last row has been addressed.

During the sustain period, the scan generator and a sustain generator (not shown) supply alternating sustain pulses so that a momentary ac-plasma sustain discharge occurs on an application of each sustain pulse. Each sustain discharge produces ultra violet light that excites surrounding phosphor to produce visible light. Each subfield within a frame contains a sufficient number of sustain pulses and, in-turn, discharges, to achieve a desired brightness for each subfield. Since each pixel can be addressed independently in each subfield, a large color palate is obtainable.

It should be understood that the foregoing description is only illustrative, and that various alternatives, combinations and modifications of the teachings described herein could be devised by those skilled in the art. For instance, the teachings are applicable to other AC plasma displays and waveform configurations, where an address discharge could potentially extend across a pixel and spread across an inter-pixel gap, affecting the address ability of an adjacent sub-pixel. The present invention is intended to embrace all such alternatives, modifications and variances that fall within the scope of the appended claims.

What is claimed is:

1. A method for controlling electrodes in a plasma display, comprising:

providing addressing signals, during an addressing period, to (a) a first electrode in a first row, a second electrode in a second row, a fifth electrode in a fifth row and a sixth electrode in a sixth row; and subsequently to (b) a third electrode in a third row and a fourth electrode in a fourth row, wherein said second row is adjacent to said first row, said third row is adjacent to said second row, said fourth row is adjacent to said third row, said fifth row is adjacent to said fourth row and said sixth row is adjacent to said fifth row.

2. The method of claim 1, wherein said providing addressing signals is performed, in sequence, to said first electrode, said second electrode, said fifth electrode and said sixth electrode, and subsequently to said third electrode and said fourth electrode.

3. The method of claim 1, further comprising:

disabling (i) a sustain electrode in said third row and (ii) a sustain electrode in said fourth row, while providing said addressing signals to said first, second, fifth and sixth electrodes.

4. The method of claim 3, further comprising disabling (i) a sustain electrode in said first row, (ii) a sustain electrode in said second row, (iii) a sustain electrode in said fifth row, and (iv) a sustain electrode in said sixth row, while providing said addressing signals to said third and fourth electrodes.

5. The method of claim 1, wherein said first electrode is a first scan electrode and said second electrode is a second scan electrode, wherein said plasma display includes a first sustain electrode in said first row and a second sustain electrode in said second row, and wherein said first and second scan electrodes are between said first and second sustain electrodes.

6. The method of claim 5, wherein said third electrode is a third scan electrode, wherein said plasma display includes a third sustain electrode in said third row, and wherein said second and third sustain electrodes are between said second and third scan electrodes.

7. The method of claim 1, wherein said plasma display includes a first sustain electrode in said first row, a second sustain electrode in said second row, a third sustain electrode in said third row, and a four sustain electrode in said fourth row, wherein said first and second sustain electrodes are enabled and disabled concurrently with one another, and wherein said third and fourth sustain electrodes are enabled and disabled concurrently with one another.

8. The method of claim 7, wherein said first and second sustain electrodes are coupled to a first bus, and wherein said third and fourth sustain electrodes are coupled to a second bus.

9. The method of claim 7, wherein said plasma display further includes a fifth sustain electrode in said fifth row, and a sixth sustain electrode in said sixth row, and wherein said fifth and sixth sustain electrodes are enabled and disabled concurrently with said first and second sustain electrodes.

10. The method of claim 9, wherein said plasma display further includes a seventh sustain electrode in a seventh row adjacent to said sixth row, and an eighth sustain electrode in an eighth row adjacent to said seventh row, and wherein said seventh and eighth sustain electrodes are enabled and disabled concurrently with said third and fourth sustain electrodes.

11. A method for controlling electrodes in a plasma display, wherein said plasma display includes:

a first row having a first sustain electrode and a first scan electrode, a second row, adjacent to said first row, having a second sustain electrode and a second scan electrode, a third row, adjacent to said second row, having a third sustain electrode and a third scan electrode, and a fourth row, adjacent to said third row, having a fourth sustain electrode and a fourth scan electrode, and wherein said method comprises:

(a) disabling said third and fourth sustain electrodes, while providing addressing signals to said first scan electrode and said second scan electrode, during an addressing period; and (b) disabling said first and second sustain electrodes, while providing addressing signals to said third scan electrode and said fourth scan electrode, during said addressing period.

12. A plasma display, comprising:

a first electrode in a first row;

a second electrode in a second row adjacent to said first row;

a third electrode in a third row adjacent to said second row; and a fourth electrode in a fourth row adjacent to said third row, wherein said first and second electrodes are enabled and disabled concurrently with one another, during an addressing period, and wherein said third and fourth electrodes are enabled and disabled concurrently with one another, during said addressing period.

13. The plasma display of claim 12, wherein said first and second electrodes are coupled to a first bus, and wherein said third and fourth electrodes are coupled to a second bus.

14. The plasma display of claim 12, wherein said first electrode is a first sustain electrode, and said second electrode is a second sustain electrode, and wherein said plasma display further comprises:

a first scan electrode in said first row; and a second scan electrode in said second row, wherein said first and second scan electrodes are between said first and second sustain electrodes.

15. The plasma display of claim 14, wherein said third electrode is a third sustain electrode, and wherein said plasma display further comprises:

a third scan electrode in said third row, wherein said second and third sustain electrodes are between said second and third scan electrodes.

16. The plasma display of claim 14, wherein said fourth electrode is a fourth sustain electrode, and wherein said plasma display further comprises:

a fourth scan electrode in said fourth row, wherein said third and fourth scan electrodes are between said third and fourth sustain electrodes.

17. The plasma display of claim 12, further comprising:

a fifth electrode in a fifth row adjacent to said fourth row; and a sixth electrode in a sixth row adjacent to said fifth row, wherein said fifth and sixth electrodes are enabled and disabled concurrently with said first and second electrodes.

18. The plasma display of claim 17, further comprising:

a seventh electrode in a seventh row adjacent to said sixth row; and an eighth electrode in an eighth row adjacent to said seventh row, wherein said seventh and eighth electrodes are enabled and disabled concurrently with said third and fourth electrodes.

19. The plasma display of claim 17, further comprising a controller for:

(a) addressing said first row, said second row said fifth row and said sixth row, and subsequently, (b) addressing said third row and said fourth row.

20. The plasma display of claim 17, further comprising a controller for:

(a) addressing, in sequence, said first row, said second row said fifth row and said sixth row, and subsequently, (b) addressing, in sequence, said third row and said fourth row.

21. The plasma display of claim 12, further comprising a controller for disabling said third and fourth electrodes while said first and second rows are being addressed.

22. The plasma display of claim 21, wherein said controller is also for disabling said first and second electrodes while said third and fourth rows are being addressed.

23. A plasma display comprising:

a first row having a first sustain electrode and a first scan electrode;

a second row adjacent to said first row, having a second sustain electrode and a second scan electrode;

a third row adjacent to said second row, having a third sustain electrode and a third scan electrode;

a fourth row adjacent to said third row, having a fourth sustain electrode and a fourth scan electrode; and a controller for (a) disabling said third and fourth sustain electrodes while providing addressing signals, in sequence, to said first scan electrode and said second scan electrode, during an addressing period, and subsequently (b) disabling said first and second sustain electrodes while providing addressing signals, in sequence, to said third scan electrode and said fourth scan electrode, during said addressing period.

* * * * *